US011400712B2

(12) United States Patent
Bandoh

(10) Patent No.: US 11,400,712 B2
(45) Date of Patent: Aug. 2, 2022

(54) LIQUID DISCHARGE HEAD, HEAD MODULE, HEAD DEVICE, LIQUID DISCHARGE DEVICE, AND LIQUID DISCHARGE APPARATUS

(71) Applicant: Ricoh Company, Ltd., Tokyo (JP)

(72) Inventor: Yoshinori Bandoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/173,256

(22) Filed: Feb. 11, 2021

(65) Prior Publication Data

US 2021/0260874 A1 Aug. 26, 2021

(30) Foreign Application Priority Data

Feb. 20, 2020 (JP) ..... JP2020-026943

(51) Int. Cl.
*B41J 2/14* (2006.01)

(52) U.S. Cl.
CPC .. *B41J 2/14233* (2013.01); *B41J 2002/14419* (2013.01); *B41J 2002/14459* (2013.01); *B41J 2202/12* (2013.01)

(58) Field of Classification Search
CPC ..... B41J 2/14233; B41J 2002/14419; B41J 2002/14459; B41J 2202/12; B41J 2202/20; B41J 2202/21
See application file for complete search history.

(56) References Cited

U.S. PATENT DOCUMENTS

| | | | | |
|---|---|---|---|---|
| 2011/0313856 | A1 | 12/2011 | Cohen et al. | |
| 2012/0160925 | A1 | 6/2012 | Hoisington et al. | |
| 2019/0275797 | A1 * | 9/2019 | Kato | B41J 2/185 |
| 2020/0156374 | A1 | 5/2020 | Bandoh | |
| 2020/0298582 | A1 | 9/2020 | Bandoh | |

FOREIGN PATENT DOCUMENTS

| | | | | |
|---|---|---|---|---|
| JP | 2014-237323 | | 12/2014 | |
| JP | 2015-036238 | | 2/2015 | |
| JP | 3708371 | A1 * | 9/2020 | B41J 2/14 |
| WO | WO2012/091867 | A2 | 7/2012 | |

* cited by examiner

*Primary Examiner* — Geoffrey S Mruk
(74) *Attorney, Agent, or Firm* — Xsensus LLP

(57) ABSTRACT

A liquid discharge head includes a plurality of nozzles arrayed in a two-dimensional matrix, the plurality of nozzles configured to discharge a liquid, a plurality of pressure chambers respectively communicating with the plurality of nozzles, a plurality of common-supply branch channels communicating with two or more of the plurality of pressure chambers, a plurality of common-collection branch channels communicating with two or more of the plurality of pressure chambers, a common-supply main channel communicating with the plurality of common-supply branch channels, a common-collection main channel communicating with the plurality of common-collection branch channels, and a bypass channel configured to connect one of the plurality of common-supply branch channels and one of the plurality of common-supply branch channels. The plurality of common-supply branch channels and the plurality of common-supply branch channels are alternately arrayed in an array direction.

12 Claims, 18 Drawing Sheets

LIQUID DISCHARGE HEAD, HEAD MODULE, HEAD DEVICE, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-026943, filed on Feb. 20, 2020, in the Japan Patent, the entire disclosures of which is hereby incorporated by reference herein.

BACKGROUND

Technical Field

An aspect of the present disclosure relates to a liquid discharge head, a head module, a head device, a liquid discharge device, and a liquid discharge apparatus.

Related Art

A liquid discharge head includes a plurality of nozzles from which a liquid is discharged. The plurality of nozzles is arrayed in a two-dimensional matrix. The liquid is supplied to a pressure chamber from a supply-main channel through a supply-branch channel. The liquid is collected from the pressure chamber to a collection-main channel through a collection-branch channel.

The liquid discharge head includes a bypass channel that connects the collection-branch channel and the supply-branch channel. The bypass channel has a width narrower than a channel width of the supply-branch channel and the collection-branch channel.

SUMMARY

In an aspect of this disclosure, a liquid discharge head includes a plurality of nozzles arrayed in a two-dimensional matrix, the plurality of nozzles configured to discharge a liquid, a plurality of pressure chambers respectively communicating with the plurality of nozzles, a plurality of common-supply branch channels communicating with two or more of the plurality of pressure chambers, a plurality of common-collection branch channels communicating with two or more of the plurality of pressure chambers, a common-supply main channel communicating with the plurality of common-supply branch channels, a common-collection main channel communicating with the plurality of common-collection branch channels, and a bypass channel configured to connect one of the plurality of common-supply branch channels and one of the plurality of common-supply branch channels. The plurality of common-supply branch channels and the plurality of common-supply branch channels are alternately arrayed in an array direction, the plurality of common-supply branch channels includes a first common-supply branch channel, and a second common-supply branch channel having a longer channel length than the first common-supply branch channel. The first common-supply branch channel and the second common-supply branch channel are disposed on both sides of one of the plurality of common-collection branch channel in the array direction. The bypass channel includes a first bypass channel configured to connect the first common-supply branch channel and said one of the plurality of common-collection branch channel, and a second bypass channel configured to connect the second common-supply branch channel and said one of the plurality of common-collection branch channel, and a channel resistance of the first bypass channel is larger than a channel resistance of the second bypass channel.

In another aspect of this disclosure, a liquid discharge device includes the liquid discharge head as described above.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
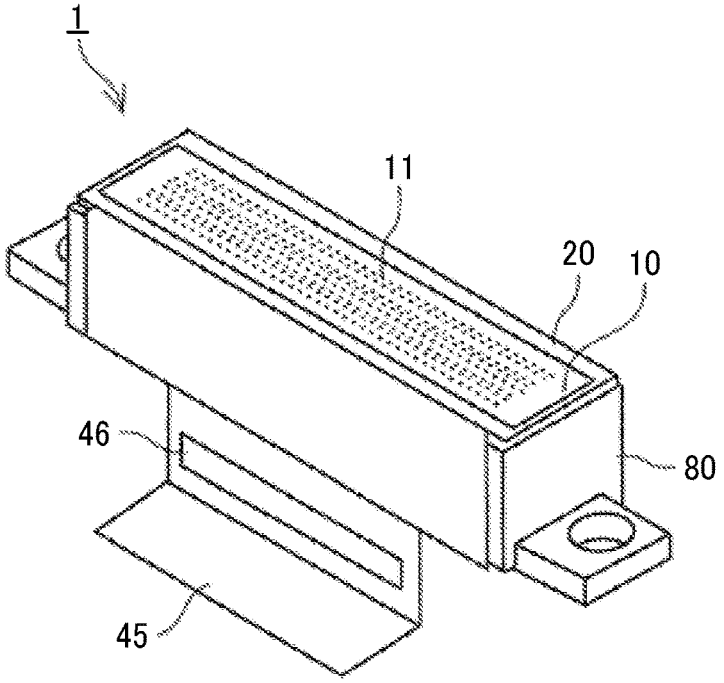
FIG. 1 is an outer perspective view of a liquid discharge head viewed from a nozzle surface side according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A liquid discharge head according to a first embodiment of the present disclosure is described with reference to FIGS. 1 to 7.

FIG. 1 is an outer perspective view of a liquid discharge head 1 viewed from a nozzle surface side according to the first embodiment.

Figure 2:
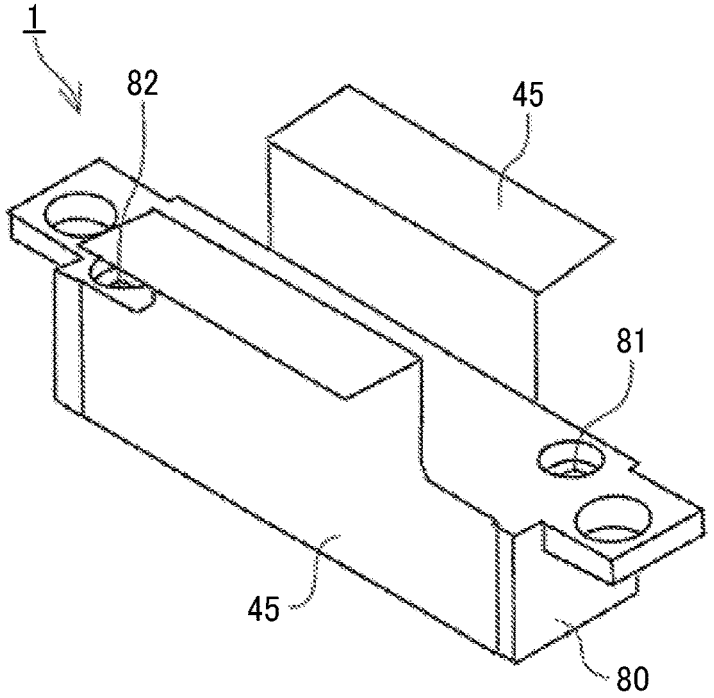
FIG. 2 is an outer perspective view of the liquid discharge head viewed from an opposite side of the nozzle surface side according to the first embodiment.

FIG. 2 is an outer perspective view of the liquid discharge head 1 viewed from an opposite side of the nozzle surface side according to the first embodiment.

Figure 3:
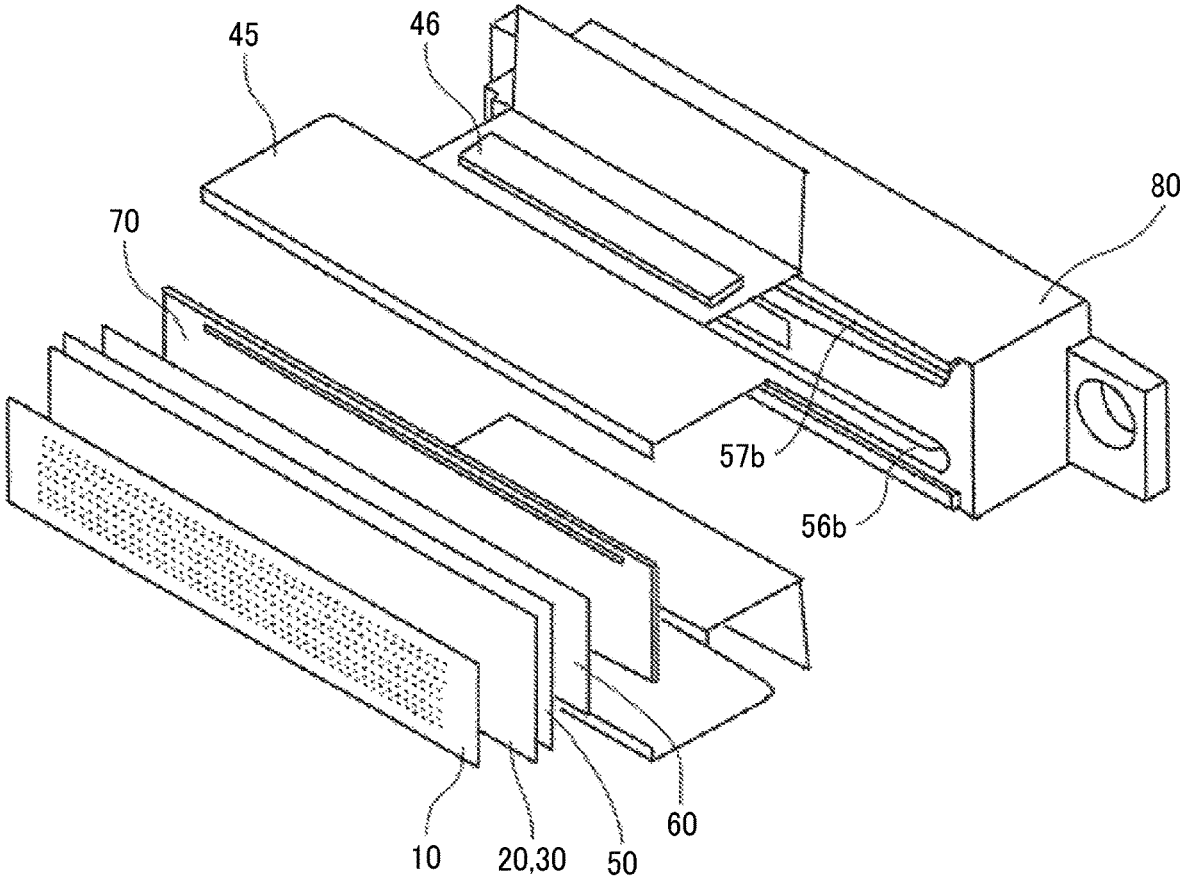
FIG. 3 is an exploded perspective view of the liquid discharge head according to the first embodiment.

FIG. 3 is an exploded perspective view of the liquid discharge head 1 according to the first embodiment.

Figure 4:
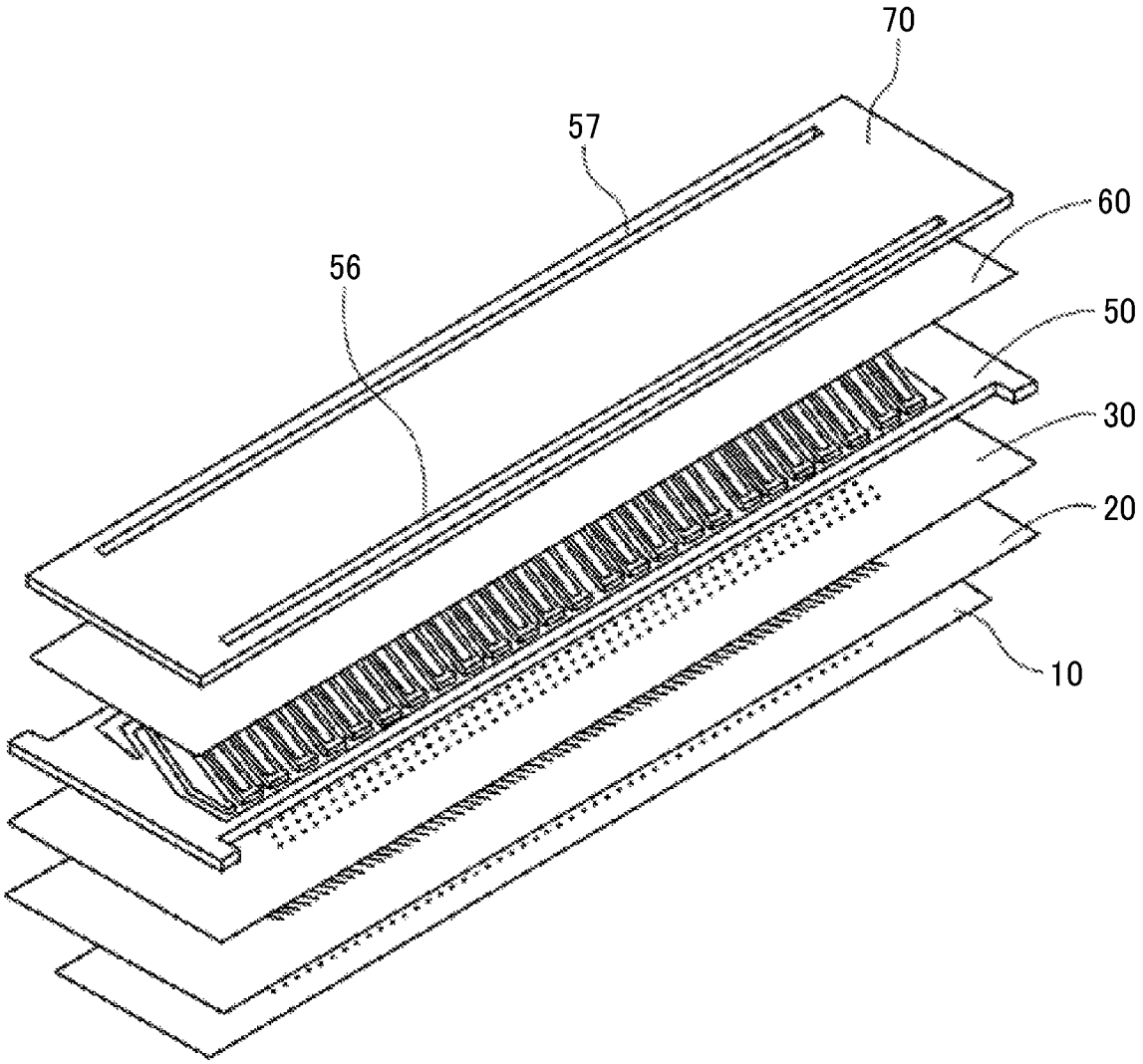
FIG. 4 is an exploded perspective view of a channel forming member of the liquid discharge head according to the first embodiment.

FIG. 4 is an exploded perspective view of a channel forming member of the liquid discharge head 1 according to the first embodiment.

Figure 5:
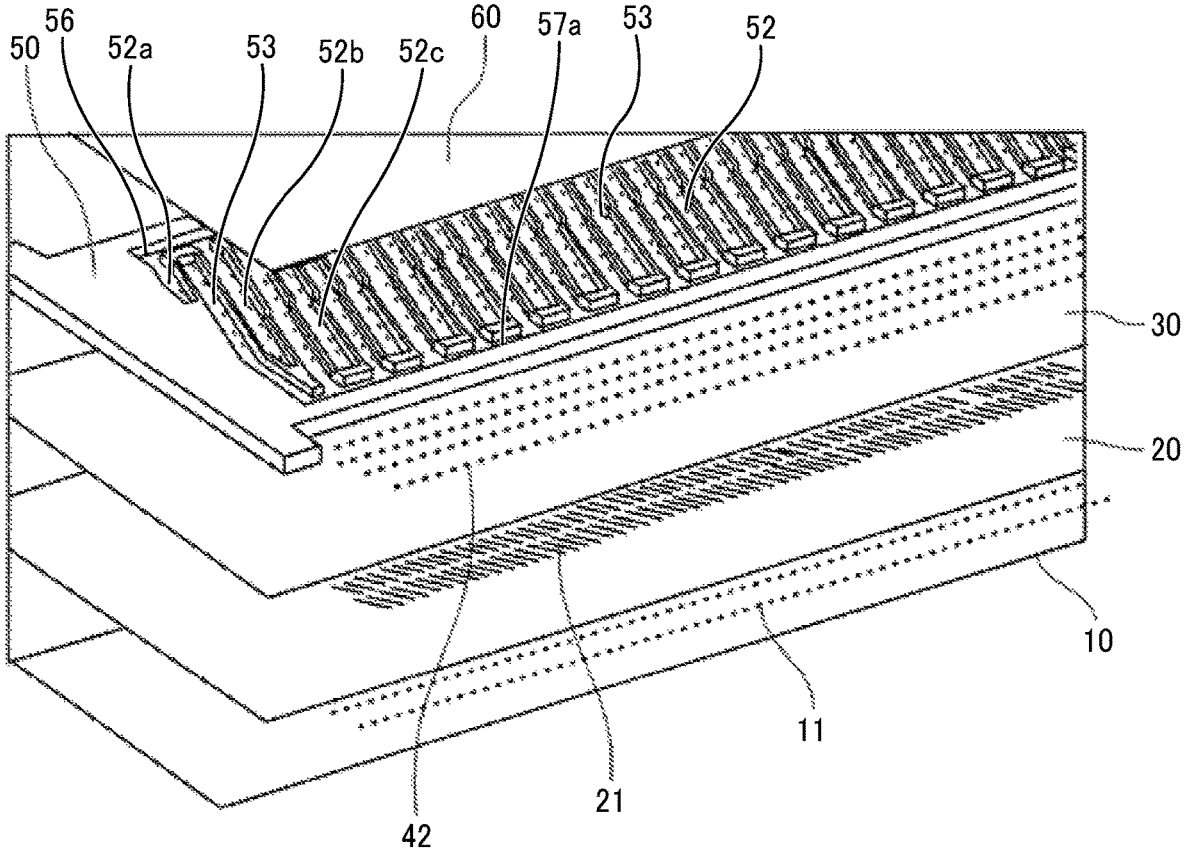
FIG. 5 is an enlarged perspective view of a portion of the channel forming member of FIG. 4.

FIG. 5 is an enlarged perspective view of a portion of the channel forming member of FIG. 4.

Figure 6:
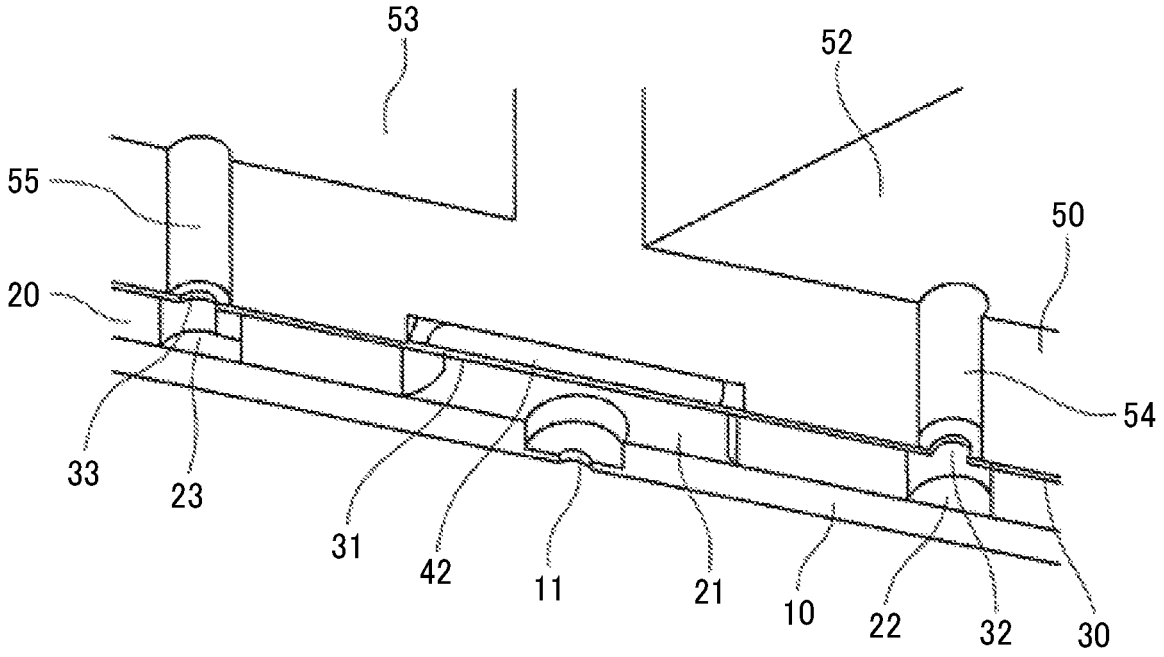
FIG. 6 is a cross-sectional perspective view of channels in the liquid discharge head according to the first embodiment.

FIG. 6 is a cross-sectional perspective view of channels of the liquid discharge head 1.

The liquid discharge head 1 includes a nozzle plate 10, an individual-channel member 20 (channel plate), a diaphragm member 30, a common-channel member 50, a damper 60, a common-channel member 70, a frame 80, and a flexible wiring board 45 (wiring). Hereinafter, the "liquid discharge head" is simply referred to as a "head."

A head driver 46 (driver IC) is mounted on the flexible wiring board 45 (wiring).

The nozzle plate 10 includes a plurality of nozzles 11 to discharge a liquid. The plurality of nozzles 11 are arrayed in a two-dimensional matrix.

The individual-channel member 20 (channel plate) includes a plurality of pressure chambers 21 (individual chambers) respectively communicating with the plurality of nozzles 11, a plurality of individual-supply channels 22 respectively communicating with the plurality of pressure chambers 21, and a plurality of individual-collection channels 23 respectively communicating with the plurality of pressure chambers 21 (see FIGS. 5 and 6).

The diaphragm member 30 forms a vibration portion 31 serving as a deformable wall of the pressure chamber 21, and the piezoelectric element 42 is formed on the vibration portion 31 so that the piezoelectric element 42 and the vibration portion 31 form a single body (see FIG. 6). Further, the diaphragm member 30 includes a supply opening 32 that communicates with the individual-supply channel 22 and a collection opening 33 that communicates with the individual-collection channel 23 (see FIG. 6). The piezoelectric element 42 is a pressure generating element to deform the vibration portion 31 to apply a pressure to the liquid in the pressure chamber 21.

Note that the individual-channel member 20 and the diaphragm member 30 are not limited to be separate members. The diaphragm member 30 includes a member made of materials that are film-formed on a surface of the individual-channel member 20.

The common-channel member 50 also serves as a common-branch channel member. The common-channel member 50 includes common channels such as a plurality of common-supply branch channels 52 that communicate with two or more individual-supply channels 22 and a plurality of common-collection branch channels 53 that communicate with two or more individual-collection channels 23. The plurality of common-supply branch channels 52 and the plurality of common-collection branch channels 53 are alternately arrayed adjacent to each other (see FIGS. 5 and 6).

As illustrated in FIG. 5, the common-channel member 50 includes a through hole serving as a supply opening 54 that connects the supply opening 32 of the individual-supply channel 22 and the common-supply branch channel 52, and a through hole serving as a collection opening 55 that connects the collection opening 33 of the individual-collection channel 23 and the common-collection branch channel 53.

Figure 7:
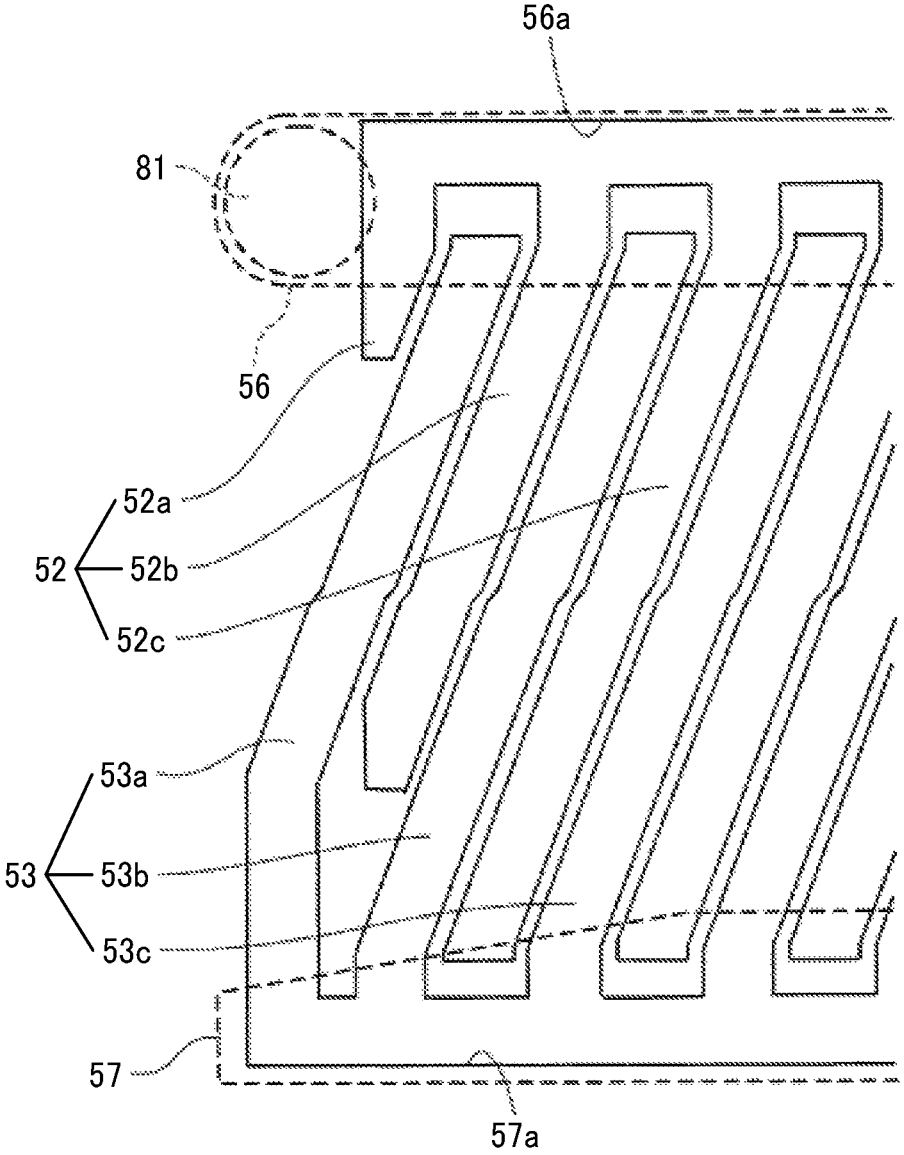
FIG. 7 is a schematic plan view of the liquid discharge head illustrating a relation between common channels, pressure chambers, and the bypass channels according to the first embodiment.

As illustrated in FIG. 7, the common-channel member 50 includes a part 56*a* of one or more common-supply main channels 56 that communicate with the plurality of common-supply branch channels 52, and a part 57*a* of one or more common-collection main channels 57 that communicate with the plurality of common-collection branch channels 53.

The damper 60 mainly functions to attenuate a pressure wave from the pressure chamber 21 to the common-supply branch channel 52 and the common-collection branch channel 53 (see FIG. 5).

As illustrated in FIG. 5, the damper 60 seals grooves alternately arrayed in the same common-channel member 50 to form the common-supply branch channels 52 and the common-collection branch channels 53. Thus, the damper 60 forms a deformable wall of the common-supply branch channels 52 and the common-collection branch channels 53.

The common-channel member 70 (see FIG. 4) is a common channel main member. The common-channel member 70 includes the common channels such as a common-supply main channel 56 that communicates with the plurality of common-supply branch channels 52 and a common-collection main channel 57 that communicate with the plurality of common-collection branch channels 53 (see FIGS. 4 and 5).

The frame 80 includes the part 56*a* of the common-supply main channel 56 and the part 57*a* of the common-collection main channel 57 (see FIG. 3). The part 56*b* (see FIG. 3) of the common-supply main channel 56 communicates with a supply port 81 (see FIG. 2) in the frame 80. The part 57*b* (see FIG. 3) of the common-collection main channel 57 communicates with a collection port 82 (see FIG. 2) in the frame 80.

In the head 1, the liquid supplied from the supply port 81 (see FIG. 2) is supplied to the pressure chamber 21 through the common-supply main channel 56 (see FIG. 4), the common-supply branch channel 52 (see FIGS. 5 and 6), and the supply opening 54 (see FIG. 6). The liquid supplied to the pressure chamber 21 is discharged from the nozzle 11. The liquid not discharged from the nozzle 11 passes through the collection opening 55 (see FIG. 6), the common-collection branch channel 53 (see FIGS. 5 and 6), and the common-collection main channel 57 (see FIG. 4), and is discharged outside the head 1 from the collection port 82.

A configuration of channels in the head 1 according to the first embodiment of the present disclosure is described with reference to FIGS. 7 to 9.

FIG. 7 is a schematic plan view of a common-channel member 50 of the head 1.

Figure 8:
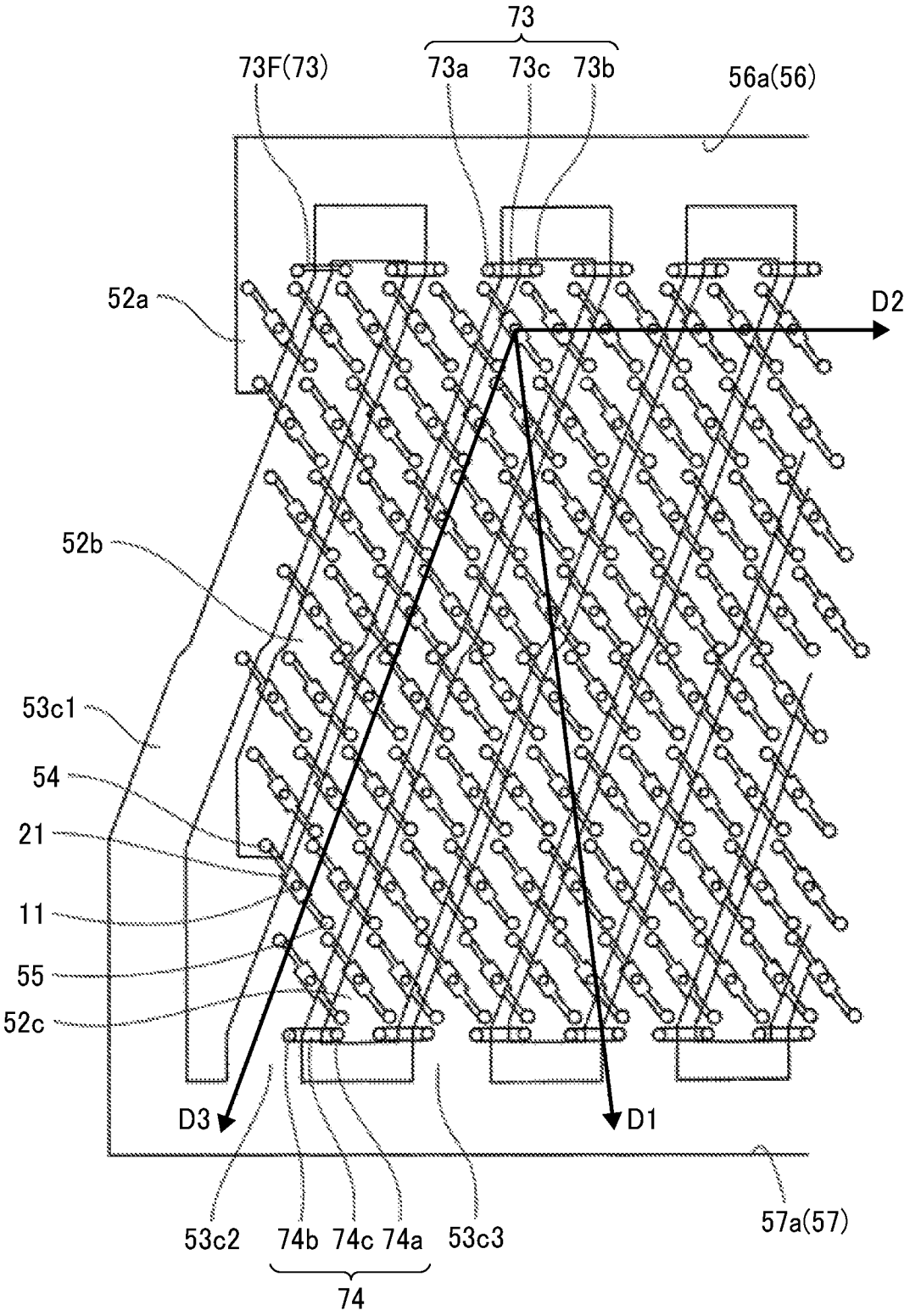
FIG. 8 is a schematic plan view of the liquid discharge head illustrating a relation between the common channels, the pressure chambers, and the bypass channels according to the first embodiment.

FIG. 8 is a schematic plan view of the head 1 illustrating a relation between the common channels, the pressure chambers 21, and the bypass channels 73 and 74. In FIG. 8, channels including branch channels, the pressure chambers 21, and the nozzles 11. FIG. 8 illustrates the channels in a transparent manner. Following figures also illustrate the channels in the transparent manner.

As described above, the common-supply branch channel 52 and the common-collection branch channel 53 are alternately arrayed adjacent to each other (see FIGS. 5 and 6).

The plurality of common-supply branch channels 52 includes three types of common-supply branch channels 52*a*, 52*b*, and 52*c* having different channel lengths from an end closest to the supply port 81 to which the liquid is supplied from an outside of the head 1 in an array direction "D2" of the common-supply branch channels 52 and the common-collection branch channels 53. The array direction of the common-supply branch channels 52 and the common-collection branch channels is indicated by arrow "D2" in FIG. 8.

Here, a channel length of the common-supply branch channel 52 is longer in an order of the common-supply branch channel 52*a* (shortest), 52*b* (next shortest), and 52*c* (longest).

Thus, the common-supply branch channel 52*a* (first common-supply branch channel) has the shortest channel length among the plurality of common-supply branch channels 52, and the common-supply branch channel 52*a* is disposed at one end (left end in FIGS. 7 to 9) of the plurality of common-supply branch channels 52 in the array direction D2.

The head 1 further includes bypass channels 73 and 74. The bypass channel 73 is on a supply side, and the bypass channel 74 is on a collection side. The bypass channels 73 and 74 connect the common-supply branch channel 52 and the common-collection branch channel 53 adjacent to each other.

Thus, the head 1 includes two bypass channels 73 to connect two common-supply branch channels 52 disposed on both sides of one common-collection branch channel 53, for example. Thus, the head 1 includes two bypass channels 74 to connect two common-collection branch channels 53 disposed on both sides of one common-supply branch channel 52, for example.

The bypass channel 73 includes an opening 73*a* communicating with the common-supply branch channel 52, an opening 73*b* communicating with the common-collection branch channel 53, and a channel 73*c* connecting through the opening 73*a* with the opening 73*b*.

The bypass channel 74 includes an opening 74*a* communicating with the common-supply branch channel 52, an opening 74*b* communicating with the common-collection branch channel 53, and a channel 74*c* connecting through the opening 74*a* with the opening 74*b*.

Figure 9:
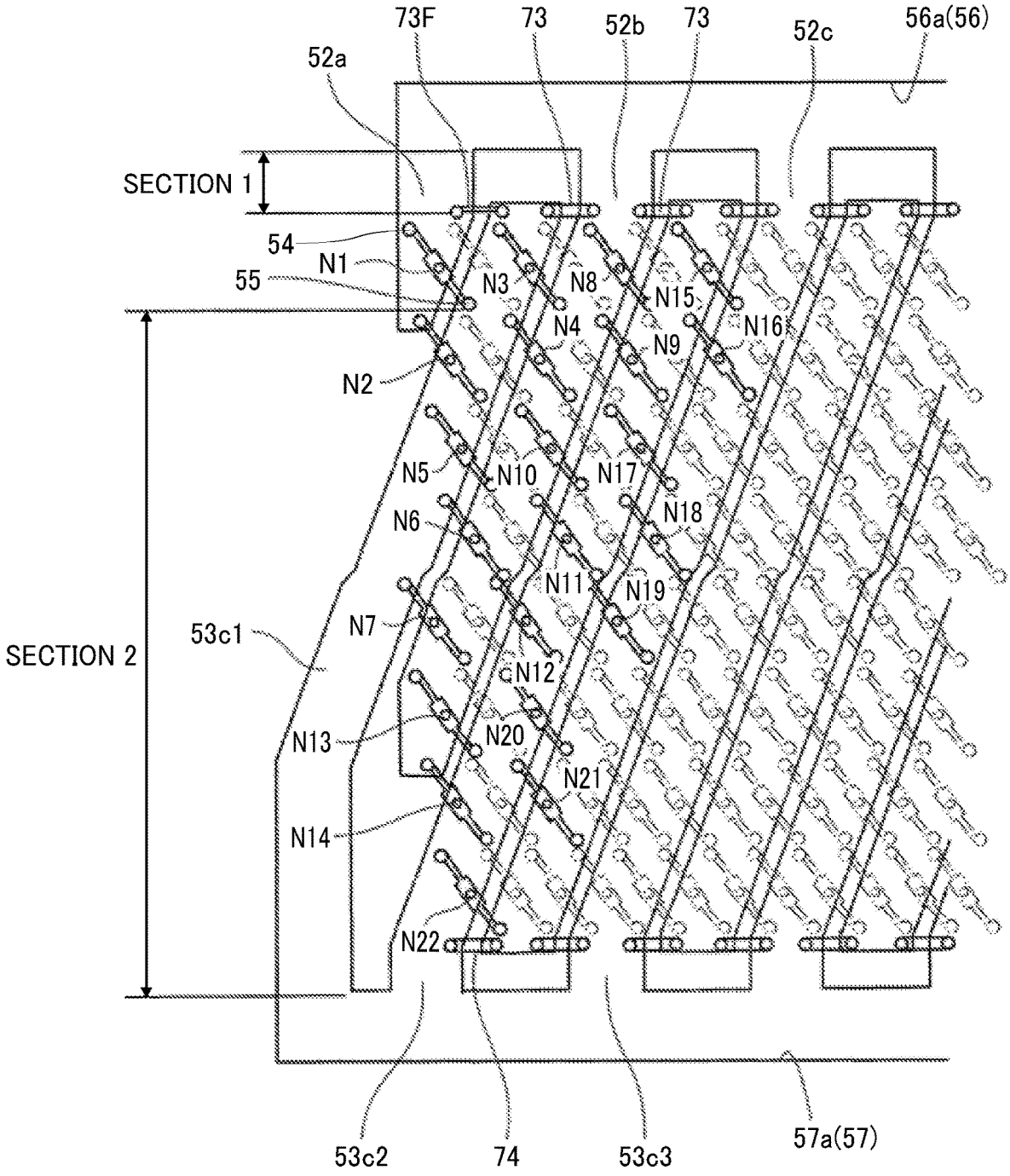
FIG. 9 is a schematic plan view of the liquid discharge head in which the nozzles illustrated in FIG. 8 are numbered.

The bypass channel 73 connects the common-supply branch channel 52 and the common-collection branch channel 53 at an inlet (upper side in FIGS. 7 and 8) of the common-supply branch channels 52 to which the liquid is supplied from the common-supply main channel 56 and also at a position close to the common-supply main channel 56 (56*a*) than the supply opening 54 and the collection opening 55 (including the pressure chamber 21) as illustrated in FIG. 9.

The bypass channel 74 connects the common-supply branch channel 52 and the common-collection branch channel 53 at an outlet (lower side in FIGS. 7 and 8) of the common-collection branch channels 53 from which the liquid is discharged to the common-collection main channel 57 and also at a position close to the common-collection main channel 57 (57*a*) than the supply opening 54 and the collection opening 55 (including the pressure chamber 21) as illustrated in FIG. 9.

In the head 1 according to the first embodiment, the channel lengths of two common-supply branch channels 52*a* and 52*b* are different. Two common-supply branch channels 52*a* and 52*b* are disposed on both sides of the common-collection branch channel 53*c*1 in an array direction of branch channels including the common-supply branch channels 52 and the common-collection branch channels 53.

Thus, a channel resistance of the bypass channel 73 (referred to as "bypass channel 73F") communicating with the common-supply branch channel 52*a* having a short channel length is made higher than a channel resistance of the bypass channel 73 (73*c*) communicating with the common-supply branch channel 52*b* having a longer channel length than the common-supply branch channel 52*a*.

A cross-sectional area of a channel may be reduced to increase the channel resistance, for example.

Next, an effect of the head 1 according to the first embodiment is described with reference to FIGS. 9 to 11.

FIG. 9 is a schematic plan view of the head 1 in which the nozzles 11 illustrated in FIG. 8 are numbered.

Figure 10:
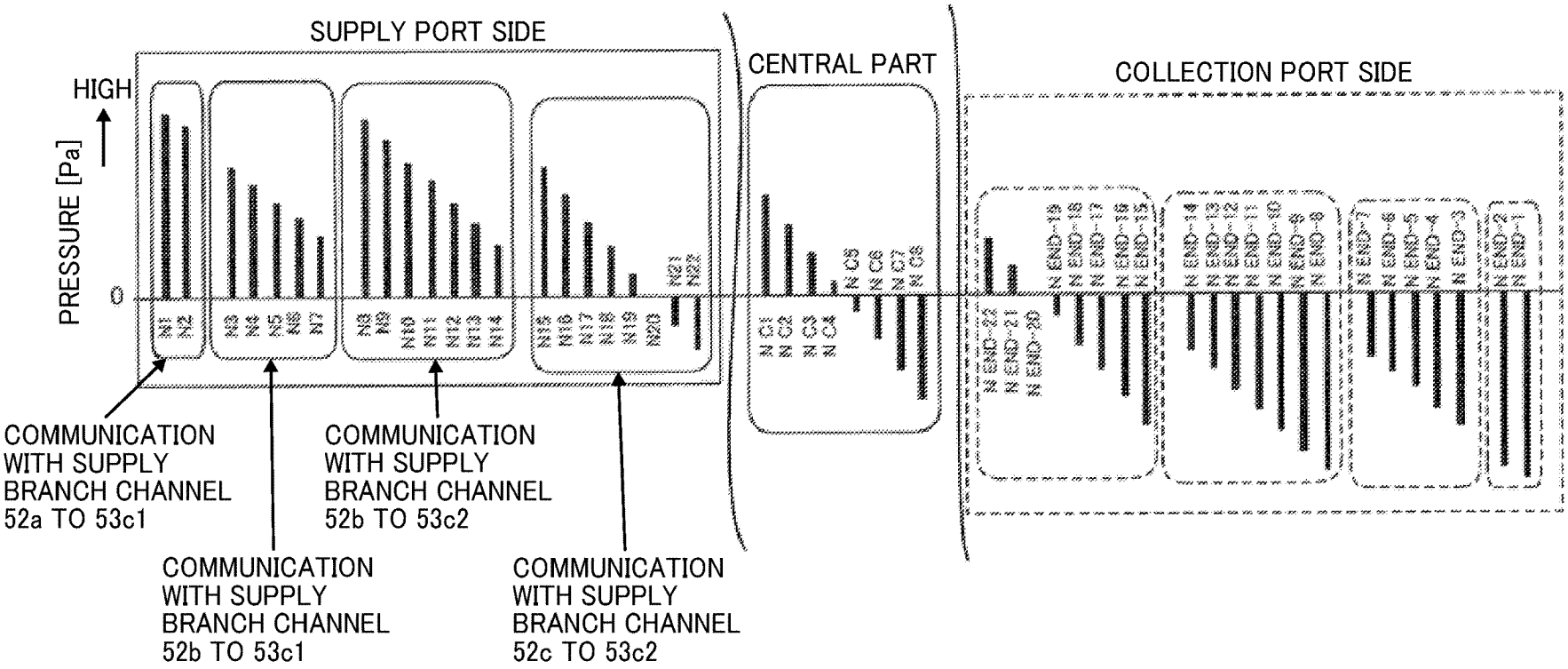
FIG. 10 is a table illustrating an example of a meniscus pressure of each nozzle if the channel resistances of all the bypass channel are identical.

FIG. 10 is a table illustrating an example of a meniscus pressure of each nozzle 11 if the channel resistances of all the bypass channel 73 are identical.

Figure 11:
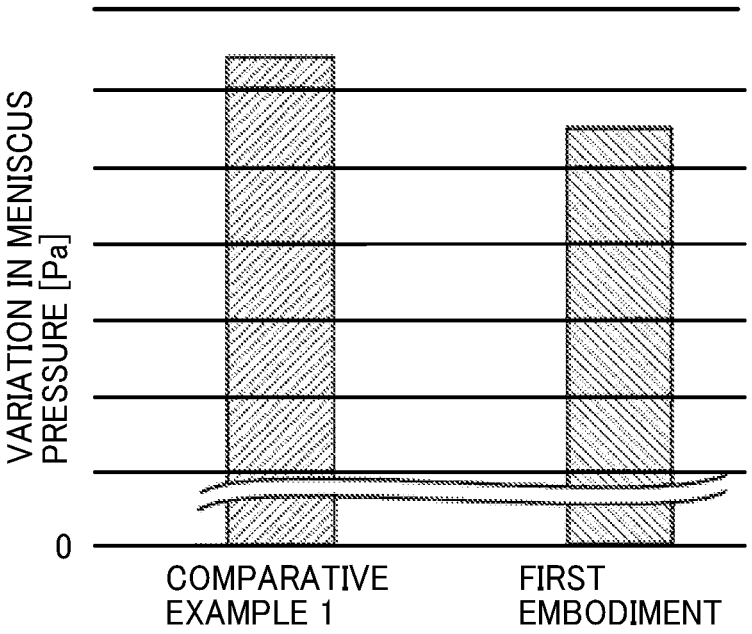
FIG. 11 is a graph illustrating an effect of the liquid discharge head according to the first embodiment.

FIG. 11 is a graph illustrating the effect of the head 1 according to the first embodiment.

FIG. 9 illustrates positions of nozzle numbers N1 to N22 of the nozzles 11 on a "supply port side" in FIG. 10. In FIG. 10, meniscus pressures are illustrated in an order of a direction indicated by arrow "D3" in FIG. 8, and then in an order of a direction indicated by arrow "D2" in FIG. 8.

The nozzles 11 (nozzle numbers N1 to N22) disposed close to the supply port 81 (see FIG. 7) are referred to as the nozzles 11 on the "supply port side" in FIG. 10. The nozzles 11 (nozzle numbers N C1 to C8) disposed in a central part in the direction D2 are referred to as the nozzles 11 on "the central part" in FIG. 10. The nozzles 11 (nozzle numbers N END-22 to N END-1) disposed close to the collection port 82 are referred to as the nozzles 11 on the "collection port side" in FIG. 10.

As illustrated in FIG. 10, when a channel resistance of the bypass channel 73F is the same as channel resistances of other bypass channels 73 on the supply port side, meniscus pressures in the nozzles 11 of the nozzle numbers N1 and N2 become relatively higher than meniscus pressures in the nozzles 11 other than the nozzle numbers N1 and N2 on the supply port side.

The nozzles 11 of the nozzle numbers N1 and N2 of the pressure chamber 21 communicate with the common-supply branch channel 52*a*. Then, among the nozzle numbers N1 and N2 of the pressure chamber 21 communicating with the common-supply branch channel 52*a*, a meniscus pressure in the nozzle 11 of the nozzle number N1 closest to the supply port 81 (the leftmost nozzle 11 in FIG. 10) becomes the highest.

The same tendency as described above is observed in the channel resistance on the collection port side.

An effect of changing the channel resistance of the bypass channel 73F on the supply side is described below. In FIGS. 9 and 10, a pressure control at an inlet and an outlet of the head 1 is adjusted to be constant.

As illustrated in FIG. 9, a section from a channel inlet of the common-supply branch channel 52*a* to a connection part of the common-supply branch channel 52*a* with the bypass channel 73F is referred to as a "section 1."

A section from a connection part (collection opening 55) between the pressure chamber 21 of the nozzle 11 of the nozzle number N1 and the common-collection branch channel 53*c*1 and a branch outlet (lower end of the common-collection branch channel 53*c*1 in FIG. 9) is referred to as a "section 2."

In the head 1 in the first embodiment, the channel resistance R1 in the section 1 is larger than the channel resistance R2 in the section 2 (R1>R2). Regarding a flow rate Q flowing through the bypass channel 73F, a flow rate Q before changing the channel resistance R is referred to as a flow rate Q1, and a flow rate Q after changing the channel resistance R is referred to as a flow rate Q2. Then, the flow rate Q1 becomes higher than the flow rate Q2 (Q1>Q2) because the flow rate Q decreases with an increase in the channel resistance R.

Regarding a pressure of the connection part (supply opening 54) between the pressure chamber 21 of the nozzle 11 of the nozzle number N1 and the common-supply branch channel 52*a* (see FIG. 9), a pressures of the connection part before changing the channel resistance R and after changing the channel resistance R are respectively referred to as a pressure Vin1 and a pressure Vin2. Regarding a pressure of the connection part (collection opening 55) between the pressure chamber 21 of the nozzle 11 of the nozzle number N1 and the common-collection branch channel 53*c*1 (see FIG. 9), a pressures of the connection part before increasing the channel resistance R and after increasing the channel resistance R are respectively referred to as a pressure Vout1 and a pressure Vout2.

When the pressure Vin1 and the pressure Vin2 are compared, if the channel resistance R of the bypass channel 73F is increased, the flow rate Q flowing through the bypass channel 73F is reduced. Thus, the flow rate Q flowing through the section 1 is reduced, and a pressure loss in the section 1 is reduced. Since the pressure Vin becomes closer to a pressure on the channel inlet side, the pressure Vin1 becomes smaller than the pressure Vin2 (Vin1<Vin2).

When the pressure Vout1 and the pressure Vout2 are compared, if the channel resistance R of the bypass channel 73F is increased, the flow rate Q flowing through the bypass channel 73F is reduced. Thus, the flow rate Q flowing through the section 2 is reduced, and a pressure loss in the section 2 is reduced. Since the pressure Vout becomes closer to a pressure on the channel outlet side, the pressure Vout1 becomes larger than the pressure Vout2 (Vout1>Vout2).

Since the channel resistance R1 is larger than the channel resistance R2 (R1>R2) in the head 1 according to the first embodiment, influence of a change in the flow rate Q flowing through the bypass channel 73F can be expressed by a following equation, (Vin2−Vin1)<−(Vout2−Vout1).

Thus, an effect of lowering the pressure on the Vout side is greater than an effect of increasing the pressure on the Vin side. Thus, an average pressure applied to the pressure chamber 21 deceases with an increase in the channel resistance of the bypass channel 73F.

FIG. 11 illustrates a variation in the meniscus pressure in a Comparative Example 1 in which the channel resistance of the bypass channel 73F is the same as the channel resistance of other bypass channels 73. FIG. 11 also illustrates the variation in the meniscus pressure in the head 1 according the first embodiment in which the channel resistance of the bypass channel 73F is made higher than the channel resistance of other bypass channels 73.

As illustrated in FIG. 11, the channel resistance R of the bypass channel 73F is made higher than the channel resistance R of other bypass channels 73 so that the variation in the meniscus pressure in the head 1 according the first embodiment becomes smaller than the variation in the meniscus pressure in the Comparative Example 1.

That is, difference in the meniscus pressure between the nozzles 11 arranged in a two-dimensional matrix becomes small. At this time, since a discharge speed and a discharge volume of the head 1 is sensitive to the meniscus pressure, the head 1 can reduce variations in a discharge characteristics such as the discharge speed and the discharge volume.

The head 1 according to a second embodiment of the present disclosure is described with reference to FIGS. 12 and 13.

Figure 12:
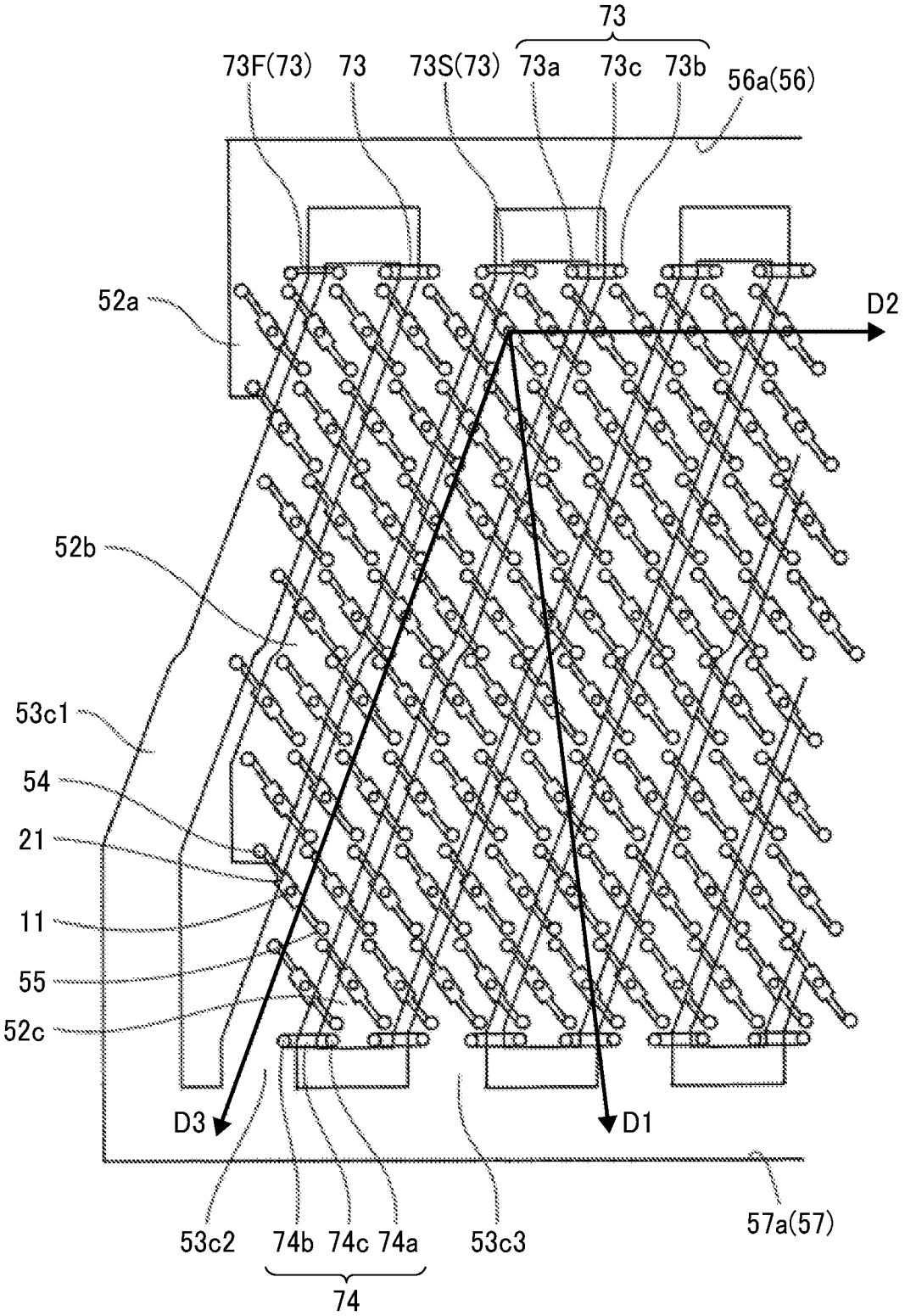
FIG. 12 is a schematic plan view of the liquid discharge head illustrating a relation between the common channels, the pressure chambers, and the bypass channels according to a second embodiment of the present disclosure.

FIG. 12 is a schematic plan view of the head 1 illustrating a relation between the common channels, the pressure chambers 21, and the bypass channels 73 and 74 according to the second embodiment.

Figure 13:
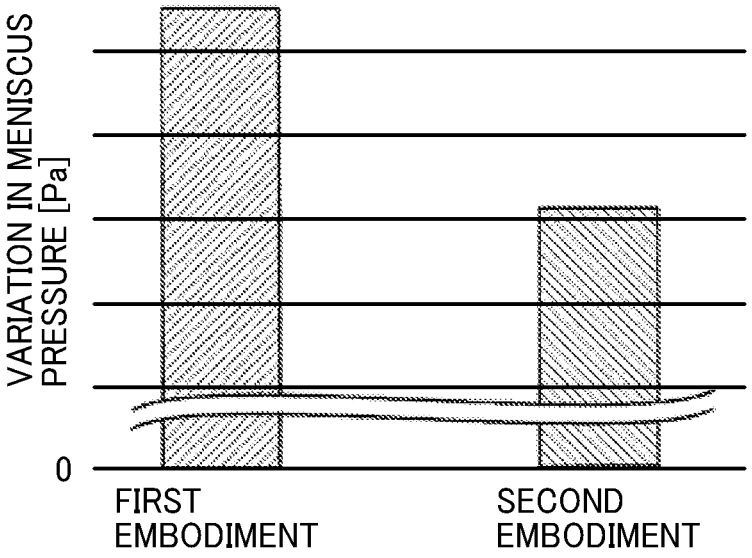
FIG. 13 is a graph illustrating an effect of the liquid discharge head according to the second embodiment.

FIG. 13 is a graph illustrating an effect of the head 1 according to the second embodiment.

The plurality of common-supply branch channels 52 includes three types of common-supply branch channels 52*a*, 52*b*, and 52*c* having different channel lengths from an end closest to the supply port 81 to which the liquid is supplied from an outside of the head 1 in the array direction D2 of the common-supply branch channels 52 and the common-collection branch channels 53.

Here, a channel length of the common-supply branch channel 52 is shorter in an order of the common-supply branch channel 52*a* (shortest), 52*b* (next shortest), and 52*c* (longest).

In the head 1 according to the second embodiment, the channel lengths of two common-supply branch channels 52*b* and 52*c* are different. Two common-supply branch channels 52*b* and 52*c* are disposed on both sides of the common-collection branch channel 53*c*2 in the array direction D2 of the branch channels including the common-supply branch channels 52 and the common-collection branch channels 53.

Two common-collection branch channels 53*c*2 and 53*c*3 are disposed on both sides of the common-supply branch channel 52*c* in the array direction D2 of the branch channels. Two common-supply branch channels 52*c*2 and 52*c*3 are disposed on both sides of the common-collection branch channel 53*c* in the array direction D2 of the branch channels.

Thus, in addition to the first embodiment, a channel resistance of the bypass channel 73 (referred to as "bypass channel 73S") communicating with the common-supply branch channel 52*b* having a short channel length is made higher than a channel resistance of the bypass channel 73 communicating with the common-supply branch channel 52*c* having a longer channel length than the common-collection branch channel 53*b* in the head 1 according to the second embodiment.

Thus, the bypass channel 73 includes the bypass channel 73S (third bypass channel) separated from the bypass channel 73F (first bypass channel). The bypass channel 73S (third bypass channel) has a channel resistance larger than the channel resistance of the bypass channel 73 (second bypass channel).

Thus, the head 1 in the second embodiment includes the bypass channel 73S communicating with the common-supply branch channel 52*b* having a shorter channel length next to the common-supply branch channel 52*a*. The channel resistance R of the bypass channel 73S is made higher than channel resistances R of other bypass channels 73. However, the channel resistance R of the bypass channel 73 connecting the common-collection branch channel 53*c*1 and the common-supply branch channel 52*b* is identical to the channel resistance R of other bypass channels 73. The common-collection branch channel 53*c*1 communicates with the bypass channel 73F.

As illustrated in FIG. 10 as described above, the meniscus pressure of the nozzle 11 of the nozzle number N8 becomes next higher to the meniscus pressure of the nozzle 11 of the nozzle number N1 (highest). A number of the pressure chambers 21 communicating with the common-supply branch channel 52*b* is smaller than a number of the pressure chambers 21 communicating with the common-supply branch channel 52*c* having the longest channel length. The pressure chamber 21 communicating with the nozzle 11 of nozzle number N8 communicates with the common-supply branch channel 52*b* as illustrated in FIG. 9, for example.

The head 1 according to the second embodiment increases not only the channel resistance of the bypass channel 73F but also the channel resistance of the bypass channel 73S as illustrated in FIG. 12. Such a configuration of the head 1 according to the second embodiment can reduce the variation in the meniscus pressure compared with the first embodiment (see FIGS. 8 and 9) as illustrated in FIG. 13. Thus, difference in the meniscus pressure between the nozzles 11 arranged in a two-dimensional matrix becomes further small.

Next, the head 1 according to a third embodiment of the present disclosure is described with reference to FIG. 14.

Figure 14:
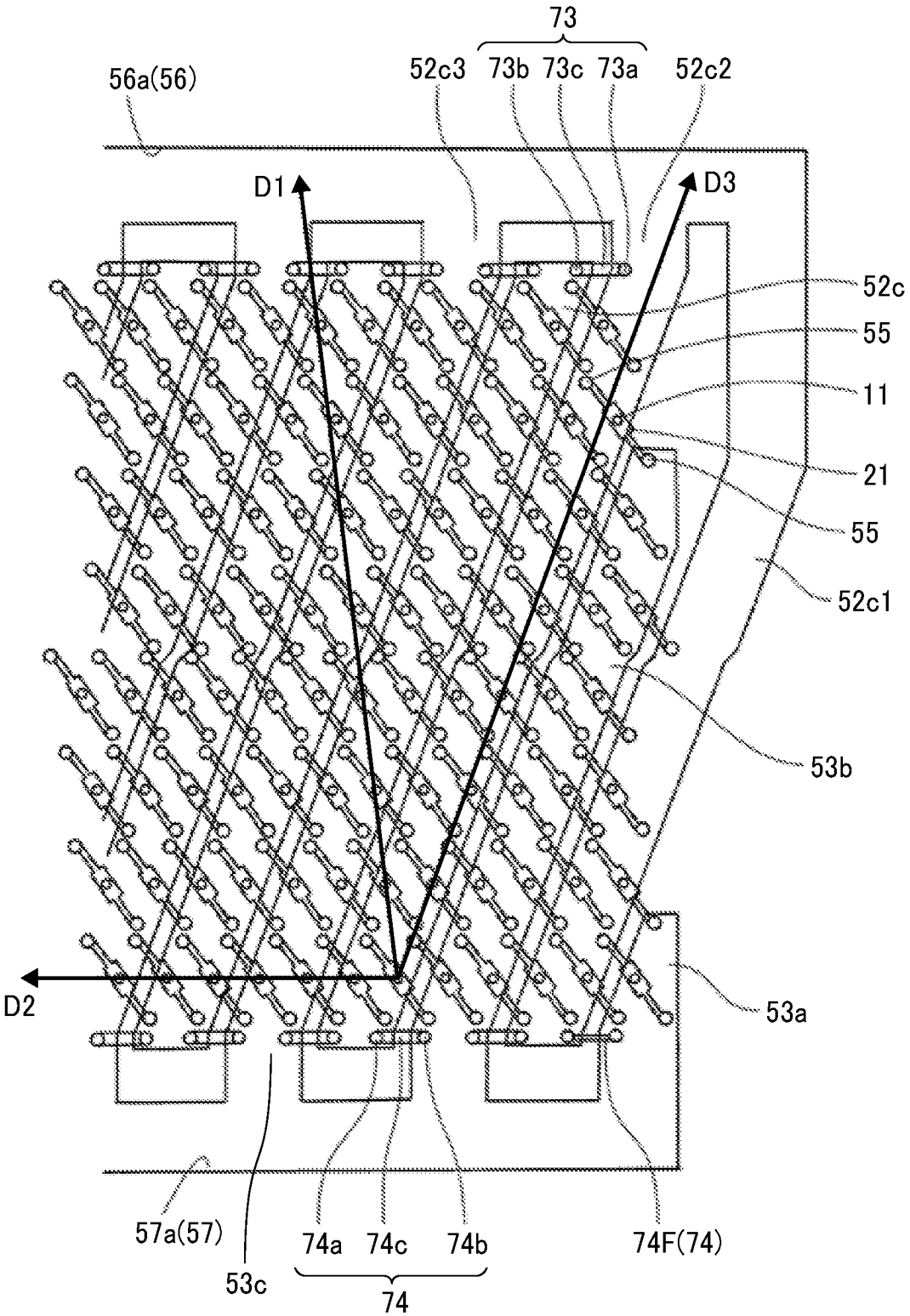
FIG. 14 is a schematic plan view of the liquid discharge head illustrating a relation between the common channels, the pressure chambers, and the bypass channels according to a third embodiment.

FIG. 14 is a schematic plan view of the head 1 illustrating a relation between the common channels, the pressure chambers 21, and the bypass channels 73 and 74 according to the third embodiment.

The plurality of common-collection branch channel 53 includes three types of common-collection branch channels 53*a*, 53*b*, and 53*c* having different channel lengths from an end closest to the collection port 82 from which the liquid is discharged outside the head 1 in the array direction D2 of the common-supply branch channels 52 and the common-collection branch channels 53.

A channel length of the common-collection branch channel 53 is shorter in an order of the common-collection branch channel 53*a* (shortest), 53*b* (next shortest), and 53*c* (longest).

In the head 1 according to the third embodiment, the channel lengths of two common-collection branch channels 53*a* and 53*b* are different. Two common-collection branch channels 53*a* and 53*b* are disposed on both sides of the common-supply branch channel 52*c*1 in the array direction D2 of the branch channels including the common-supply branch channels 52 and the common-collection branch channels 53.

Thus, the common-collection branch channel 53*a* (first common-collection branch channel) has the shortest channel length among the plurality of common-collection branch channels 53, and the common-collection branch channel 53*a* is disposed at another end (right end in FIG. 14) of the plurality of common-collection branch channels 53 opposite to said one end (left end in FIGS. 8 and 12) of the plurality of common-supply branch channels 52 in the array direction D2.

Thus, a channel resistance of the bypass channel 74 (referred to as "bypass channel 74F") communicating with the common-collection branch channel 53*a* having a short channel length is made higher than a channel resistance of the bypass channel 74 communicating with the common-collection branch channel 53*b* having a longer channel length than the common-collection branch channel 53*a*.

Thus, the head 1 in the third embodiment includes the bypass channel 74F communicating with the common-collection branch channel 53*a* with which the nozzles 11 having a nozzle number N END1 and N END2 in FIG. 10 as described above communicate. The channel resistance R of the bypass channel 74F is made higher than channel resistances R of other bypass channels 74.

Thus, the head 1 can reduce variations in the discharge characteristics as in the above-described first embodiment.

Next, the head 1 according to a fourth embodiment of the present disclosure is described with reference to FIG. 15.

Figure 15:
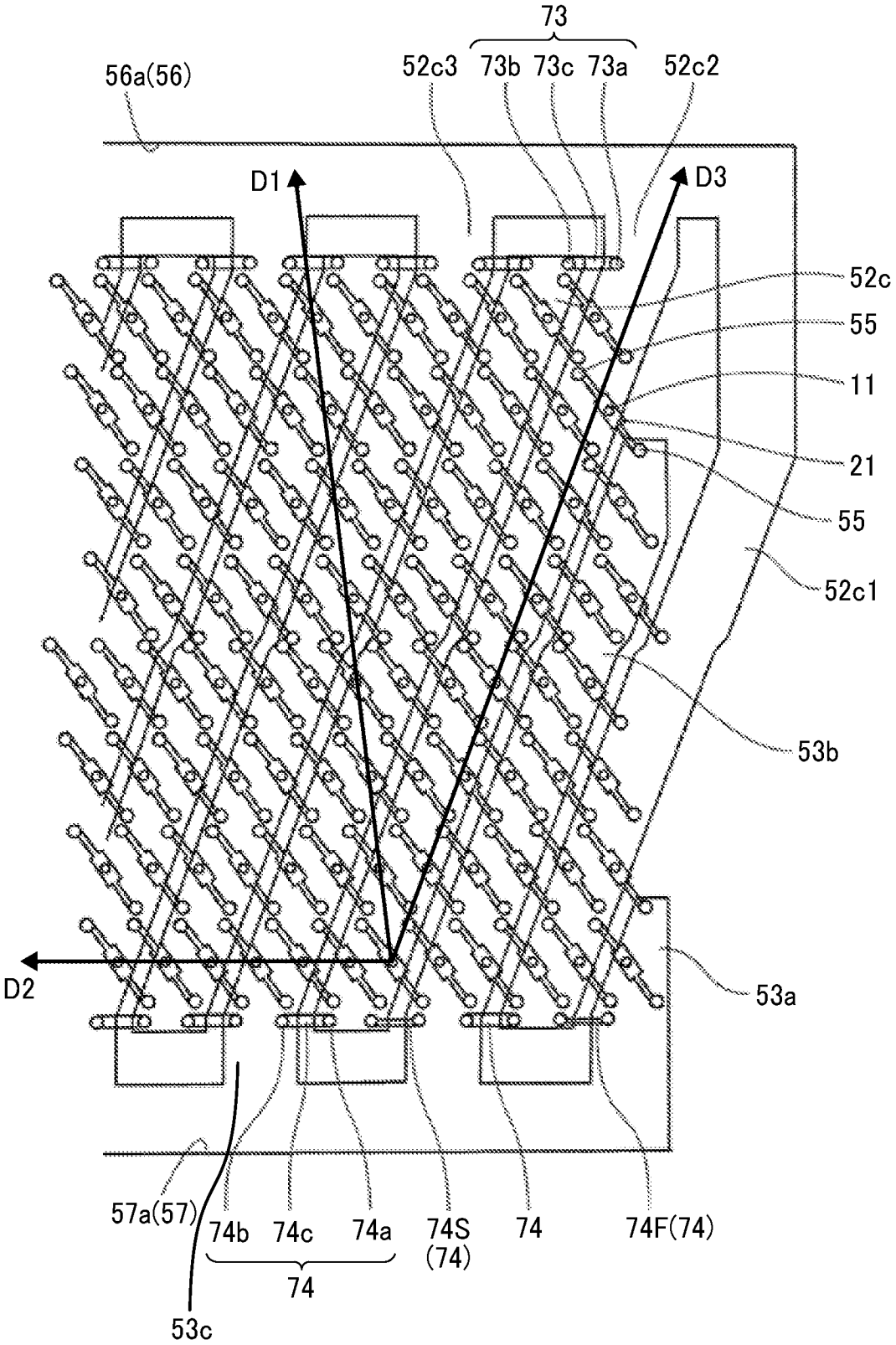
FIG. 15 is a schematic plan view of the liquid discharge head illustrating a relation between the common channels, the pressure chambers, and the bypass channels according to a fourth embodiment.

FIG. 15 is a schematic plan view of the head 1 illustrating a relation between the common channels, the pressure chambers 21, and the bypass channels 73 and 74 according to the fourth embodiment.

The plurality of common-collection branch channel 53 includes three types of common-collection branch channels 53*a*, 53*b*, and 53*c* having different channel lengths from an end closest to the collection port 82 from which the liquid is discharged outside the head 1 in the array direction D2 of the common-supply branch channels 52 and the common-collection branch channels 53.

A channel length of the common-collection branch channel 53 is shorter in an order of the common-collection branch channel 53*a* (shortest), 53*b* (next shortest), and 53*c* (longest).

In the head 1 according to the fourth embodiment, the channel lengths of two common-collection branch channels 53*b* and 53*c* are different. Two common-collection branch channels 53*b* and 53*c* are disposed on both sides of the common-supply branch channel 52*c*2 in the array direction D2 of the branch channels including the common-supply branch channels 52 and the common-collection branch channels 53.

Thus, a channel resistance of the bypass channel 74 (referred to as "bypass channel 74S") communicating with the common-collection branch channel 53*b* having a short channel length is made higher than a channel resistance of the bypass channel 74 communicating with the common-collection branch channel 53*c* having a longer channel length than the common-collection branch channel 53*b*.

Thus, the head 1 in the fourth embodiment includes the bypass channel 74F communicating with the common-collection branch channel 53*b* with which the nozzles 11 having a nozzle number N END8 in FIG. 10 as described above communicates. The channel resistance R of the bypass channel 74F is made higher than channel resistances R of other bypass channels 74.

Thus, the head 1 can reduce variations in the discharge characteristics as in the above-described second embodiment.

Further, the head 1 according to the first embodiment may be combined with the head 1 according to the third embodiment or the fourth embodiment. Further, the head 1 according to the second embodiment may be combined with the head 1 according to the third embodiment or the fourth embodiment.

Figure 16:
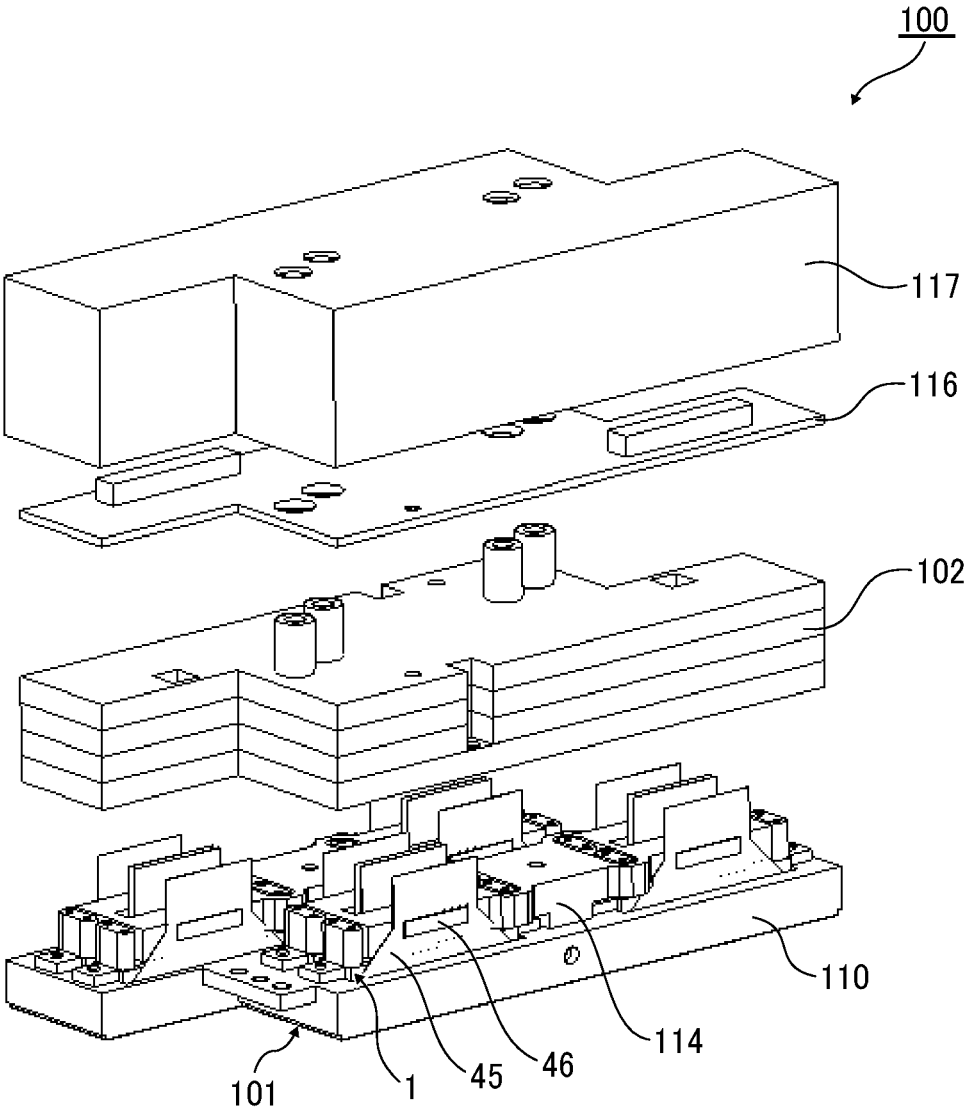
FIG. 16 is an exploded perspective view of a head module according to a fifth embodiment of the present disclosure.
Figure 17:
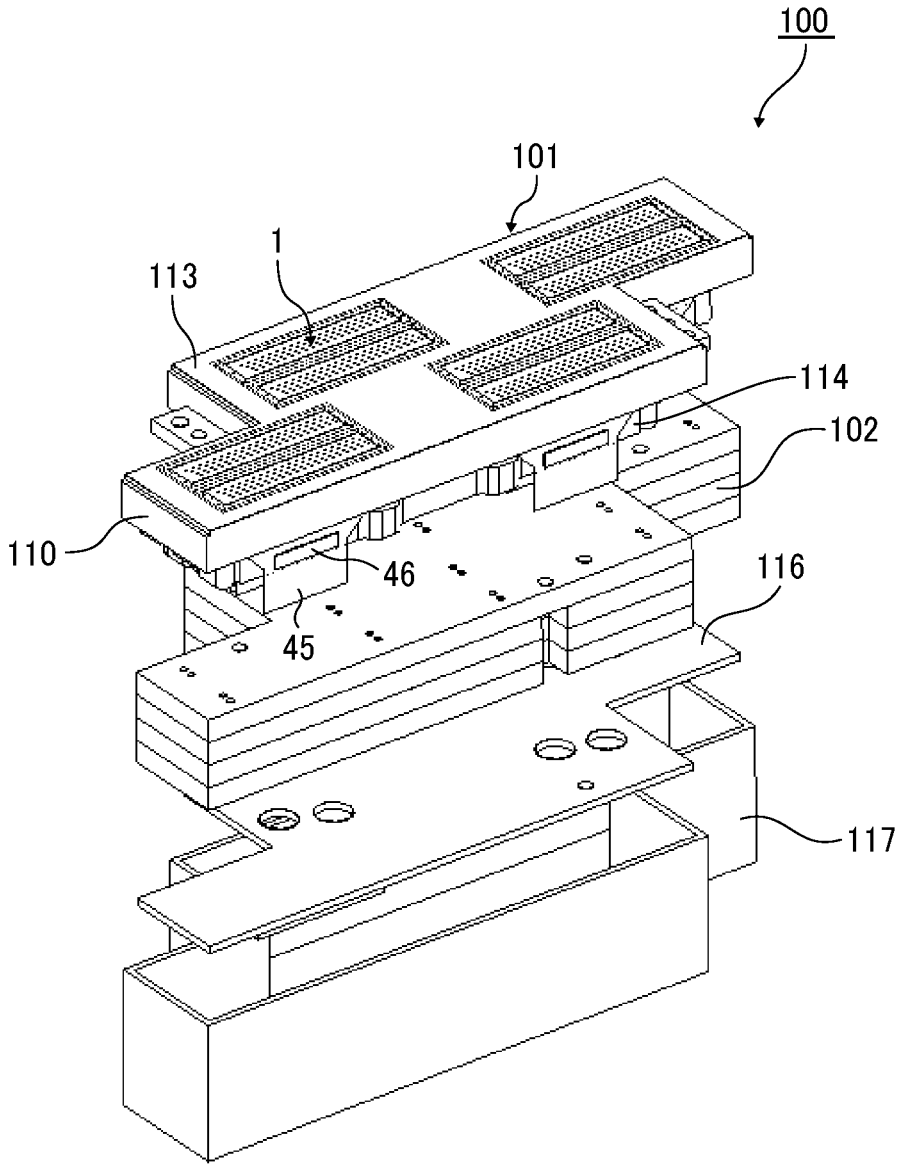
FIG. 17 is an exploded perspective view of the head module viewed from a nozzle surface side of the head module.

FIGS. 16 and 17 illustrate an example of a head module 100 according to a fifth embodiment of the present disclosure.

FIG. 16 is an exploded perspective view of the head module 100.

FIG. 17 is an exploded perspective view of the head module 100 as viewed from the nozzle surface side of the head module 100.

The head module 100 includes a plurality of (here, eight) heads 1 (liquid discharge heads) on a base 110. The head 1 is configured to discharge a liquid. The head module 100 further includes a submodule 101 to which a cover 113 serving as a nozzle cover for a plurality of heads 1 is attached.

Further, the head module 100 includes a manifold 102, a heat radiator 114, a printed circuit board 116 (PCB) connected to the flexible wiring board 45, and a module case 117.

Next, an example of a printer as a liquid discharge apparatus 500 according to a sixth embodiment of the present disclosure is described with reference to FIGS. 18 and 19.

Figure 18:
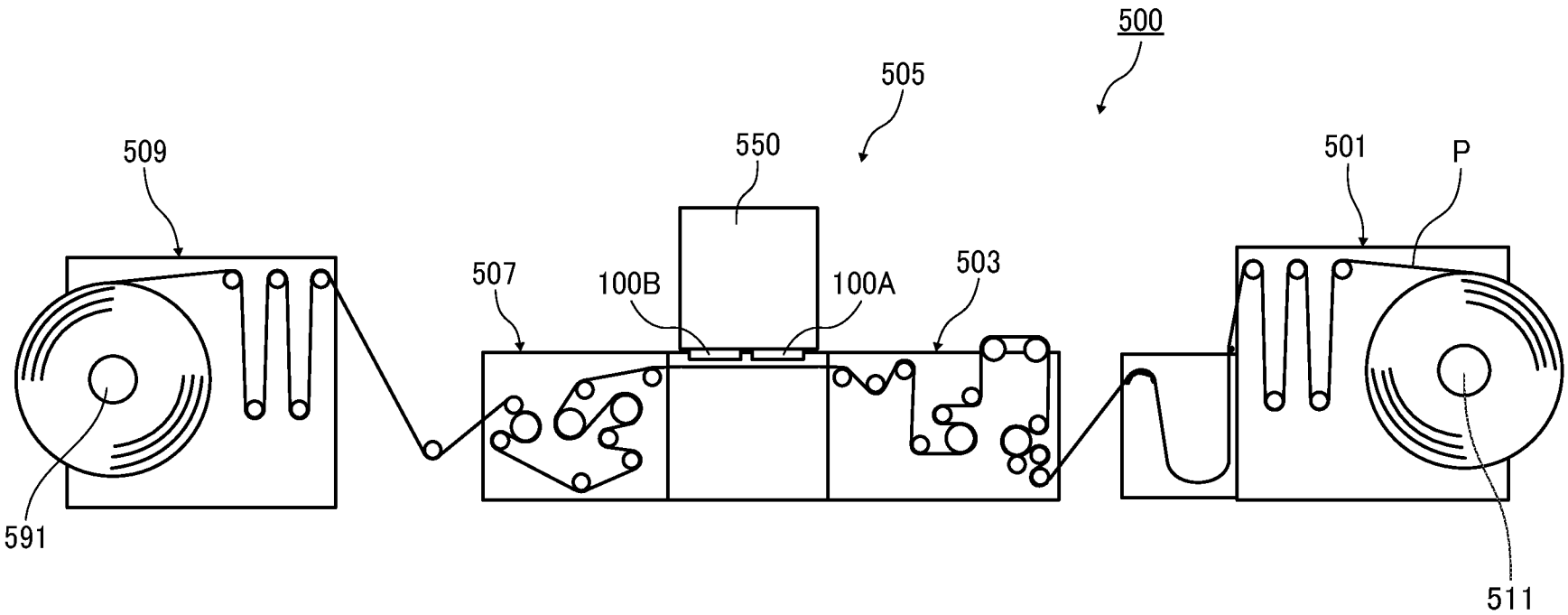
FIG. 18 is a side view of a liquid discharge apparatus according to a sixth embodiment of the present disclosure.

FIG. 18 is a side view of a liquid discharge apparatus 500 according to the sixth embodiment of the present disclosure.

Figure 19:
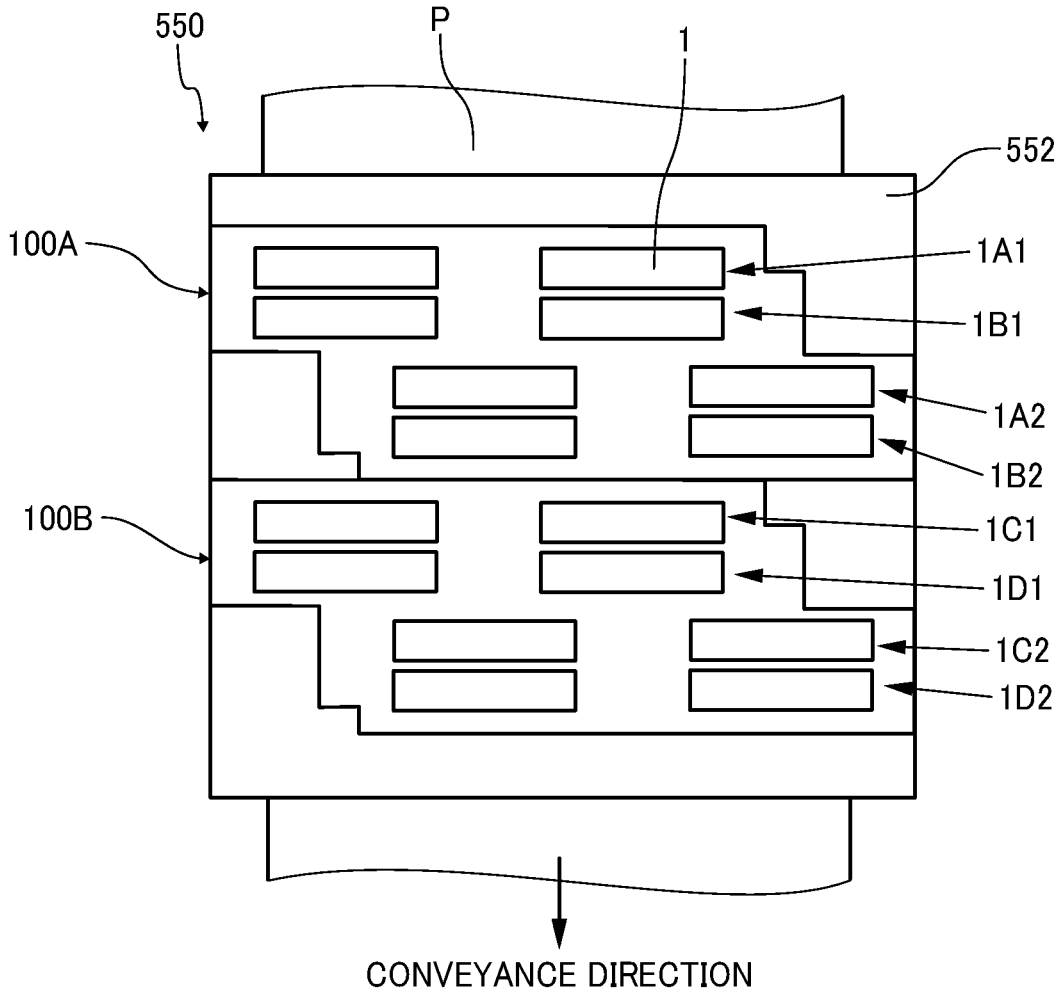
FIG. 19 is a plan view of a head unit of the liquid discharge apparatus of FIG. 18.

FIG. 19 is a plan view of a head unit 550 of the liquid discharge apparatus 500 of FIG. 18 according to the sixth embodiment.

The liquid discharge apparatus 500 is the printer that includes a loading device 501, a guide conveyor 503, a printing device 505, a drying device 507, and an ejection device 509.

The loading device 501 loads a web-like sheet P. The guide conveyor 503 guides and conveys the sheet P loaded by the loading device 501 to the printing device 505. The printing device 505 discharge a liquid onto the sheet P to form an image on the sheet P as a printing process. The drying device 507 dries the sheet P on which an image is formed by the printing device 505. The ejection device 509 ejects the sheet P conveyed from the drying device 507.

The sheet P is fed from a winding roller 511 of the loading device 501, guided and conveyed with rollers of the loading device 501, the guide conveyor 503, the drying device 507, and the ejection device 509, and wound around a take-up roller 591 of the ejection device 509.

In the printing device 505, the sheet P is conveyed opposite the head unit 550 on a conveyance guide. The head unit 550 discharges a liquid from the nozzles 11 of the heads 1 to form an image on the sheet P.

Here, the head unit 550 includes two head modules 100A and 100B on a common base member 552 (see FIG. 19).

The head module 100A includes head arrays 1A1, 1B1, 1A2, and 1B2. Each of the head arrays 1A1, 1B1, 1A2, and 1B2 includes a plurality of heads 1 arranged in a head array direction perpendicular to a conveyance direction of the sheet P as indicated by arrow in FIG. 19.

The head module 100B includes head arrays 1C1, 1D1, 1C2, and 1D2. Each of the head arrays 1C1, 1D1, 1C2, and 1D2 includes a plurality of heads 1 arranged in the head array direction perpendicular to the conveyance direction of the sheet P. The head 1 in each of the head arrays 1A1 and 1A2 of the head module 100A discharges liquid of the same desired color.

Similarly, the head arrays 1B1 and 1B2 of the head module 100A are grouped as one set that discharge liquid of the same desired color. The head arrays 1C1 and 1C2 of the head module 100B are grouped as one set that discharge liquid of the same desired color. The head arrays 1D1 and 1D2 of the head module 100B are grouped as one set to discharge liquid of the same desired color.

In the present embodiments, a "liquid" discharged from the head is not particularly limited as long as the liquid has a viscosity and surface tension of degrees dischargeable from the head.

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or unit(s) combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms a part of a maintenance unit may be secured to the carriage mounting the head so that the head, the carriage, and the maintenance unit form a single unit to form the liquid discharge device.

Further, in another example, the liquid discharge device includes tubes connected to the head mounting the head tank or the channel member so that the head and a supply unit form a single unit. Liquid is supplied from a liquid reservoir source to the head via the tube.

The main scan moving unit may be a guide only. The supply unit may be a tube(s) only or a loading unit only.

Here, the "liquid discharge device" may be a single unit in which the head and other functional parts are combined with each other. However, the "liquid discharge device" may include a head module including the above-described head, and a head device in which the above-described functional components and mechanisms are combined to form a single unit.

The term "liquid discharge apparatus" used herein also represents an apparatus including the head, the liquid discharge device, the head module, and the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include units to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles arrayed in a two-dimensional matrix, the plurality of nozzles configured to discharge a liquid;

a plurality of pressure chambers respectively communicating with the plurality of nozzles;

a plurality of common-supply branch channels communicating with two or more of the plurality of pressure chambers;

a plurality of common-collection branch channels communicating with two or more of the plurality of pressure chambers;

a common-supply main channel communicating with the plurality of common-supply branch channels;

a common-collection main channel communicating with the plurality of common-collection branch channels; and a bypass channel configured to connect one of the plurality of common-supply branch channels and one of the plurality of common-supply branch channels, wherein the plurality of common-supply branch channels and the plurality of common-supply branch channels are alternately arrayed in an array direction, the plurality of common-supply branch channels includes:

a first common-supply branch channel; and a second common-supply branch channel having a longer channel length than the first common-supply branch channel, the first common-supply branch channel and the second common-supply branch channel are disposed on both sides of one of the plurality of common-collection branch channel in the array direction, the bypass channel includes:

a first bypass channel configured to connect the first common-supply branch channel and said one of the plurality of common-collection branch channel, and a second bypass channel configured to connect the second common-supply branch channel and said one of the plurality of common-collection branch channel, and a channel resistance of the first bypass channel is larger than a channel resistance of the second bypass channel.

2. The liquid discharge head according to claim 1, wherein the plurality of common-collection branch channels includes:

a first common-collection branch channel; and a second common-collection branch channel having a longer channel length than the first common-collection branch channel, the first common-collection branch channel and the second common-collection branch channel are disposed on both sides of one of the plurality of common-supply branch channels, the bypass channel includes:

a first bypass channel configured to connect the first common-collection branch channel and said one of the plurality of common-supply branch channels, and a second bypass channel configured to connect the second common-collection branch channel and said one of the plurality of common-supply branch channels, and a channel resistance of the first bypass channel is larger than a channel resistance of the second bypass channel.

3. The liquid discharge head according to claim 1, wherein the first common-supply branch channel has the shortest channel length among the plurality of common-supply branch channels, and the first common-supply branch channel is disposed at one end of the plurality of common-supply branch channels in the array direction.

4. The liquid discharge head according to claim 3, wherein the plurality of common-collection branch channels includes:

a first common-collection branch channel; and a second common-collection branch channel having a longer channel length than the first common-collection branch channel, and the first common-collection branch channel has the shortest channel length among the plurality of common-collection branch channels, and the first common-collection branch channel is disposed at another end of the plurality of common-collection branch channels opposite to said one end of the plurality of common-supply branch channels in the array direction.

5. The liquid discharge head according to claim 1, wherein the bypass channel includes a third bypass channel separated from the first bypass channel, the third bypass channel has a channel resistance larger than the channel resistance of the second bypass channel.

6. The liquid discharge head according to claim 1, wherein the bypass channel connects said one of the plurality of common-supply branch channels and said one of the plurality of common-collection branch channels at an inlet of said one of the plurality of common-supply branch channels to which the liquid is supplied from the common-supply main channel.

7. The liquid discharge head according to claim 1, wherein the bypass channel connects said one of the plurality of common-collection branch channels and said one of the plurality of common-collection branch channels at an outlet of said one of the plurality of common-collection branch channels from which the liquid is discharged to the common-collection main channel.

8. A head module comprising:

the liquid discharge head according to claim 1, wherein the liquid discharge head includes an array of a plurality of liquid discharge heads.

9. A head device comprising the head module according to claim 8.

10. A liquid discharge device comprising the head device according to claim 9.

11. A liquid discharge apparatus comprising the liquid discharge device according to claim 10.

12. A liquid discharge head comprising:

a plurality of nozzles arrayed in a two-dimensional matrix, the plurality of nozzles configured to discharge a liquid;

a plurality of pressure chambers respectively communicating with the plurality of nozzles;

a plurality of common-supply branch channels communicating with two or more of the plurality of pressure chambers;

a plurality of common-collection branch channels communicating with two or more of the plurality of pressure chambers;

a common-supply main channel communicating with the plurality of common-supply branch channels;

a common-collection main channel communicating with the plurality of common-collection branch channels; and a bypass channel configured to connect one of the plurality of common-supply branch channels and one of the plurality of common-supply branch channels, wherein the plurality of common-supply branch channels and the plurality of common-supply branch channels are alternately arrayed in an array direction, the plurality of common-collection branch channels includes:

a first common-collection branch channel; and a second common-collection branch channel having a longer channel length than the first common-collection branch channel, the first common-collection branch channel and the second common-collection branch channel disposed on both sides of one of the plurality of common-supply branch channel, the bypass channel includes:

a first bypass channel configured to connect the first common-collection branch channel and said one of the plurality of common-supply branch channel, and a second bypass channel configured to connect the second common-collection branch channel and said one of the plurality of common-supply branch channel, and a channel resistance of the first bypass channel is larger than a channel resistance of the second bypass channel.

* * * * *